US005939690A

United States Patent [19]

Yasui et al.

[11] Patent Number: 5,939,690

[45] Date of Patent: Aug. 17, 1999

[54] STRUCTURE OF PUSH-ON SWITCH

[75] Inventors: Toyokazu Yasui; Hisashi Watanabe, both of Okayama-ken; Masaki Sawada, Osaka, all of Japan

[73] Assignee: Matsushita Electric Industrial Co., Ltd., Osaka, Japan

[21] Appl. No.: 08/993,121

[22] Filed: Dec. 18, 1997

[30] Foreign Application Priority Data

Dec. 19, 1996 [JP] Japan ..... 8-339291

[51] Int. Cl.[6] ..... H01H 13/06

[52] U.S. Cl. ..... 200/302.2; 200/512

[58] Field of Search ..... 200/5 A, 16 R–16 D, 200/512–517, 520, 534, 535, 302.1, 302.2, 341, 344, 345

[56] References Cited

U.S. PATENT DOCUMENTS 3,600,528 8/1971 Leposavic ..... 200/5
3,729,600 4/1973 Solomon et al. ..... 200/16 D
3,982,089 9/1976 Hyltin ..... 200/159 B
4,820,887 4/1989 Schmitz ..... 200/43.18
4,843,197 6/1989 Kojima et al. ..... 200/406
5,152,540 10/1992 Kuze ..... 277/208
5,760,352 6/1998 Ishihara et al. ..... 200/16 D

*Primary Examiner*—Michael A. Friedhofer
*Attorney, Agent, or Firm*—Lowe Hauptman Gopstein Gilman & Berner

[57] ABSTRACT

A dustproof push-on switch for use in an electronic device is provided which includes a base, a movable contact, a stationary contact, and a push button. The push button is made of an elastic member and hermetically held by the base to protect the movable contact and the stationary contact from dust and dirt. The base has formed thereon an annular peripheral side wall and an annular rib to form an annular groove therebetween. The push button is fitted into the annular groove in elastically tight engagement therewith.

14 Claims, 6 Drawing Sheets

STRUCTURE OF PUSH-ON SWITCH

BACKGROUND OF THE INVENTION

1. Technical Field of the Invention

The present invention relates generally to an improved structure of a dustproof push-on switch used in electronic devices.

2. Background of Related Art

FIG. 8 shows a conventional push-on switch which generally includes the box-like resinous base 1, the terminals 2 and 4, the outer stationary contacts 3A and 3B, the central stationary contact 5, the movable contact 6, and the push button 7.

The movable contact 6 consists of the annular plate 6A and the central disc 6B. The annular plate 6A is in contact with the outer stationary contacts 3A and 3B. The central disc 6B is, as shown in FIG. 9(*a*), connected to the annular plate 6A through the bridge 6C and bent upward at the bridge 6C, as shown in FIG. 9(*b*), so that it may lie at a given interval away from an inner wall of the push button 7.

The push button 7 is made from rubber and includes the thin-walled dome 7A, the thick-walled flange 7B, the cylindrical protrusion 7C, and the small-diameter inner protrusion 7D. The push button 7 is fitted at the flange 7B in the curled peripheral wall 1A of the base 1 tightly, thereby avoiding the ingress of dirt and dust into the inside of the push button 7.

In operation, depression of the protrusion 7C of the push button 7 through the operating button 8 installed in, for example, an electronic device will cause, as shown in FIG. 10, the thin-walled dome 7A to be deformed elastically to bring the central disc 6B of the movable contact 6 into engagement with the central stationary contact 5 through the inner protrusion 7D, thereby establishing an electric connection between the outer stationary contacts 3A and 3B and the central stationary contact 5, that is, between the terminals 2 and 4.

The above conventional push-on switch, however, has the following drawbacks.

The electric engagement of the outer stationary contacts 3A and 3B with the annular plate 6A of the movable contact is, as apparent from the above, accomplished by the elastic pressure exerted on the annular plate 6A from the curled peripheral wall 1A of the base 1 through the flange 7B. Thus, too weak elastic pressure provided by the curled peripheral wall 1A will result in disconnection between the outer stationary contacts 3A and 3B and the annular plate 6A. Conversely, too strong elastic pressure will cause the annular plate 6A to be deformed, thereby resulting in a change in interval between the central disc 6B and the central stationary contact 5.

The elastic movement of the curled peripheral wall 1A occurring when the push button 7 is fitted into the base 1 may also cause the position of the movable contact 6 to be changed, thereby resulting in a change in interval between the inner protrusion 7D of the push button 7 and the central disc 6B.

Further, if a circuit board collides with an upper portion of the protrusion 7C horizontally, as shown in FIG. 11, during installation of the push-on switch in an electronic device, for example, it may cause the flange 7B of the push button 7 to be moved out of engagement with the curled peripheral wall 1A, resulting in removal of the push button 7 from the base 1.

SUMMARY OF THE INVENTION

It is therefore a principal object of the present invention to avoid the disadvantages of the prior art.

It is another object of the present invention to provide an improved structure of a dustproof push-on switch designed to establish tight engagement of an push button with a base while keeping constant intervals between the push button and a movable contact and between the movable contact and a stationary contact.

According to one aspect of the present invention, there is provided a push-on switch which comprises: (a) a resinous base having an annular peripheral wall and a surface surrounded by the annular peripheral wall; (b) a curled portion formed on an end of the annular peripheral wall of the resinous base, the curled portion extending inward; (c) an annular rib formed on the surface of the resinous base inside the annular peripheral wall to define an annular groove between an outer wall of the annular rib and an inner wall of the annular peripheral wall; (d) a first stationary contact disposed on the surface of the resinous base inside the annular rib; (e) a second stationary contact disposed on a bottom of the annular groove; (f) a movable contact including an outer annular portion and a central portion, the outer annular portion being disposed in the the annular groove in electric connection with the second stationary contact and supporting the central portion at a contact gap away from the first stationary contact; (g) an operating button made from elastic material, including a central protrusion, a dome-shaped peripheral portion, and a flange portion formed on a periphery of the dome-shaped peripheral portion, the flange portion being fitted into the annular groove in tight engagement with the curled portion, the dome-shaped peripheral portion being held by the curled portion and the annular rib in tight engagement therewith to retain the central protrusion above the central portion of the movable contact.

In the preferred mode of the invention, the central portion of the movable contact is connected to the outer annular portion through a bridge portion and disposed inside the annular rib. The annular rib has formed therein a cut-out portion through which the bridge portion of the movable contact passes.

The curled portion elastically urges the flange portion of the operating button to bring the outer annular portion of the movable contact into constant engagement with the second stationary contact.

A recess is formed in the bottom of the annular groove. The movable contact is made of a plate member having a given thickness. The second stationary contact is disposed within the recess at a given interval away from an inner side wall of the recess which is five to fifteen times the given thickness of the movable contact.

The second stationary contact projects from the bottom of the annular groove by a distance less than the given thickness of the movable contact.

A second bridge portion may be provided which connects the central portion and the outer annular portion of the movable contact. The second bridge portion extends radially from the central portion at a given angular interval away from the bridge portion.

The outer annular portion of the movable contact is held within the annular groove in press-fit with one of the outer wall of the annular rib and the inner wall of the annular peripheral wall.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings:

FIG. 6(*b*) is a side view of FIG. 6(*a*);

FIG. 9(*b*) is a side view of FIG. 9(*a*);

DESCRIPTION OF THE PREFERRED EMBODIMENT

Figure 1:
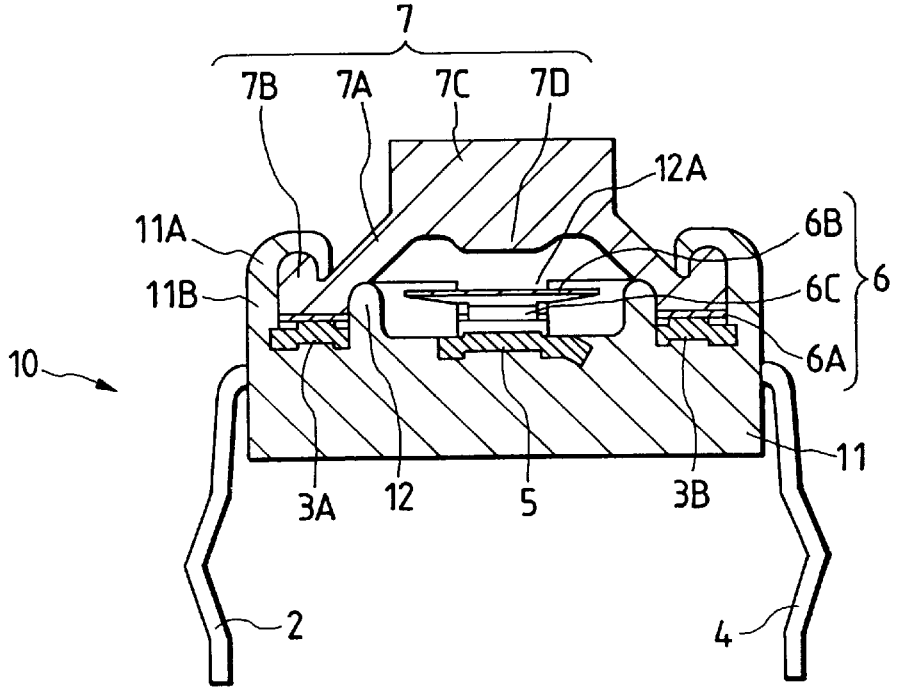
FIG. 1 is a cross sectional view which shows a push-on switch according to the first embodiment of the invention.

Referring now to the drawings, particularly to FIG. 1, there is shown a push-on switch 10 according to the present invention.

The push-on switch 10 includes the box-like casing or base 11, the terminals 2 and 4, the outer stationary contacts 3A and 3B, the central stationary contact 5, the movable contact 6, and the operating button or push button 7.

Figure 2:
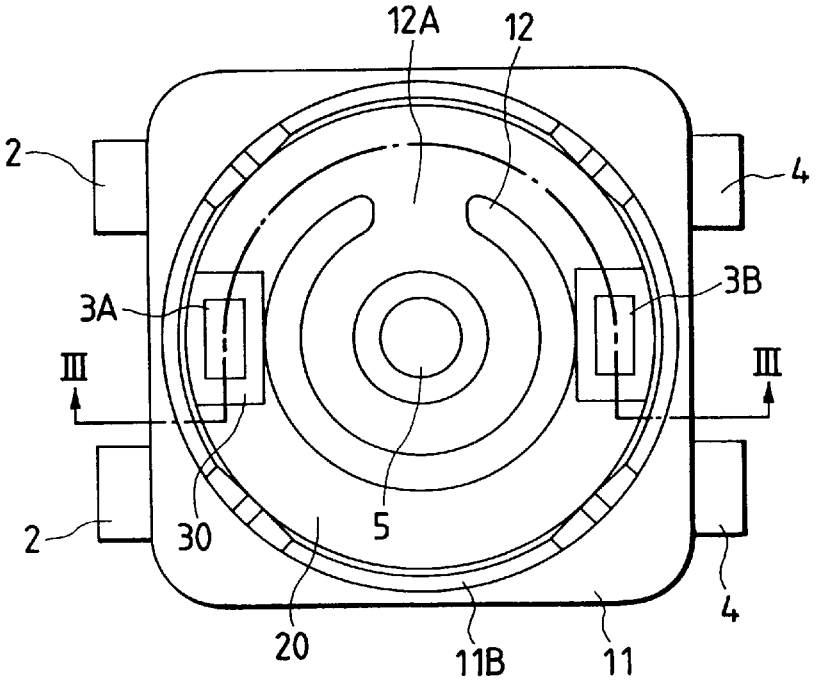
FIG. 2 is a plan view which shows a base of the push-on switch in FIG. 1.

The base 11 is made from resin and has, as shown in FIGS. 1 and 2, the annular peripheral wall 11B extending upward vertically. The annular peripheral wall 11b has the curled end portion 11A which, as shown in FIG. 1, projects inward. The base 11 has also formed on an upper surface thereof the annular rib 12 which defines the annular groove 20, as shown in FIG. 2, between itself and the annular peripheral wall 11*b* beneath the curled end portion 11A. The annular rib 12 has formed therein the cut-out portion 12A.

The central stationary contact 5 and the outer stationary contacts 3A and 3B are installed in the base 11 in the insert molding process. The central stationary contact 5 is connected to the terminals 4. The outer stationary contacts 3A and 3B are diametrically opposed to each other and connected to the terminals 2.

Figure 3:
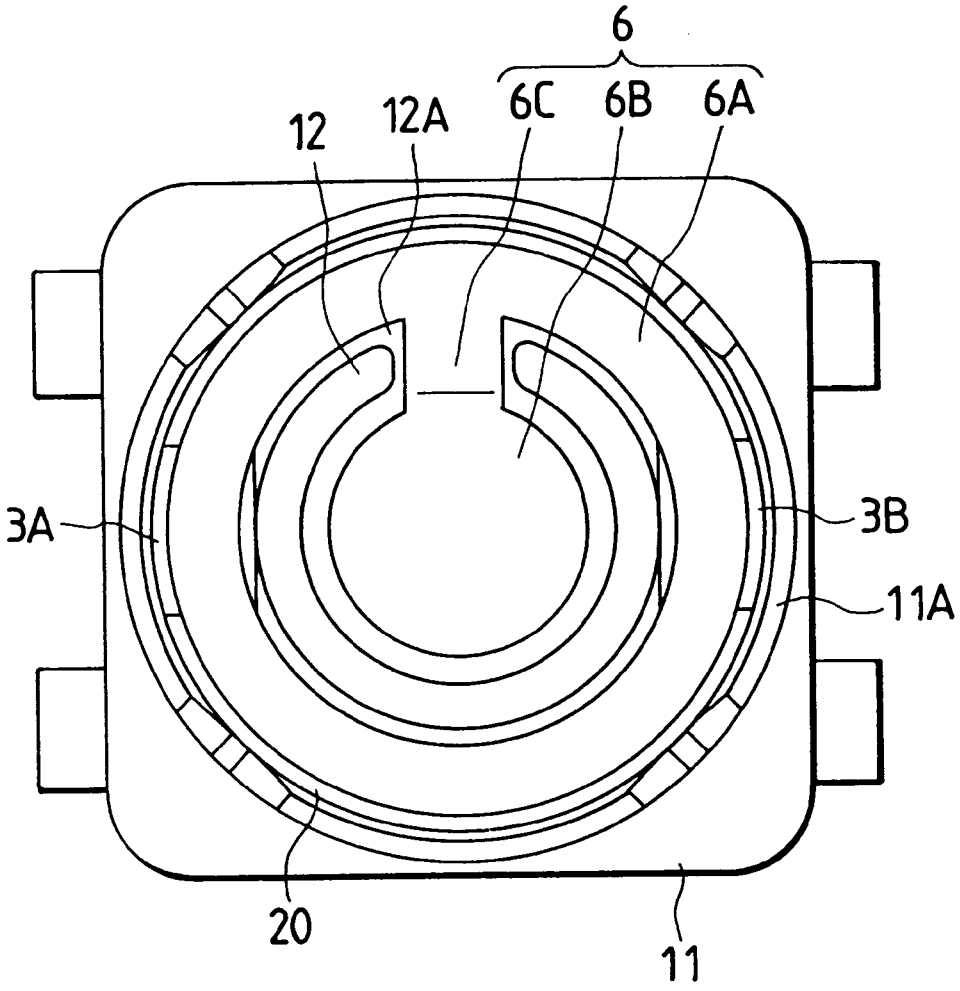
FIG. 3 is a plan view which shows a base of the push-on switch on which a movable contact is mounted.

The movable contact 6 is made of a metallic thin plate and is mounted on the upper surface of the base 11. The movable contact, as clearly shown in FIG. 3, consists of the outer annular plate 6A and the central disc 6B. The outer annular plate 6A is, as shown in FIG. 3, disposed within the annular groove 20 in contact with the outer stationary contacts 3A and 3B. The central disc 6B is disposed inside the annular plate 6A in electric connection with the annular plate 6A through the bridge 6C and bent upward at the bridge 6C, as shown in FIG. 1, so that it may lie at a given interval (i.e., a contact gap) away from the central stationary contact 5. The bridge 6C is disposed within the cut-out portion 12A.

The push button 7 is made from rubber and includes the thin-walled dome 7A, the thick-walled flange 7B, the cylindrical protrusion 7C, and the small-diameter inner protrusion 7D. The flange 7B has an annular projection which extends upward and which is contoured to an inner wall of the curled end portion 11A of the base 11. The push button 7 is fitted at the flange 7B into the annular groove 20. The flange 7B elastically engages the inner wall of the curled end portion 11A and is urged by the curled end portion 11A so as to bring the outer annular plate 6A into constant engagement with the outer stationary contacts 3A and 3B. The thin-walled dome 7A is, as clearly shown in FIG. 1, held by the base 11 elastically in tight engagement with an edge of the curled end portion 11A and an upper end of the annular rib 12. This prevents the push button 7 from being removed from the base 11 by an accidental external pressure.

Figure 4:
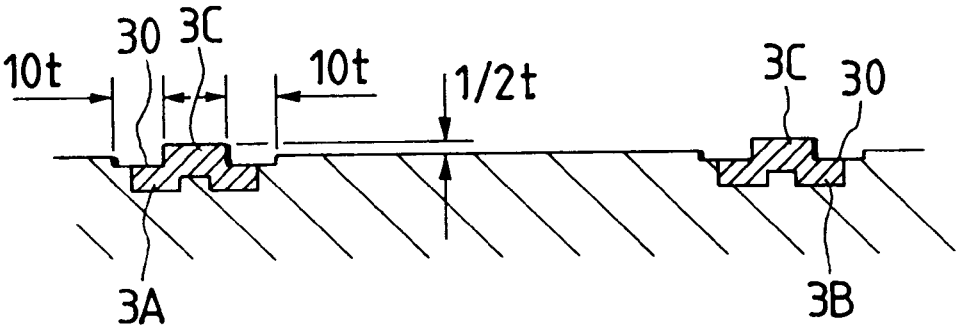
FIG. 4 is a cross sectional view taken along the line IIII—IIII in FIG. 2.

FIG. 4 is a cross sectional view taken along the line IIII—IIII in FIG. 2 which shows the installation of the outer stationary contacts 3A and 3B in the bottom of the annular groove 20 (i.e., the upper surface of the base 11).

Each of the outer stationary contacts 3A and 3B is, as can be seen from the drawing, inserted partially into the rectangular recess 30 formed in the bottom of the annular groove 20. The head 3*c* of each of the outer stationary contacts 3A and 3B projects from the bottom of the annular groove 20 by half the thickness t of the movable contact 6 and lies at the interval 11t, that is five to fifteen times, preferably, ten times the thickness t, away from an outer edge of the rectangular recess 30. Therefore, the outer annular plate 6A of the movable contact 6 is hardly deformed even when it undergoes a strong elastic pressure exerted by the curled end portion 11A of the base 11 through the flange 7B of the push button 7. Additionally, the formation of the rectangular recesses 30 in the annular groove 20 serves to establish constant engagement of the outer stationary contacts 3A and 3B with the outer annular plate 6A of the movable contact 6.

In operation, depression of the protrusion 7C of the push button 7 will cause the thin-walled dome 7A to be deformed elastically to bring the central disc 6B of the movable contact 6 into engagement with the central stationary contact 5 through the inner protrusion 7D, thereby making an electric connection between the outer stationary contacts 3A and 3B and the central stationary contact 5, that is, between the terminals 2 and 4.

Figure 5:
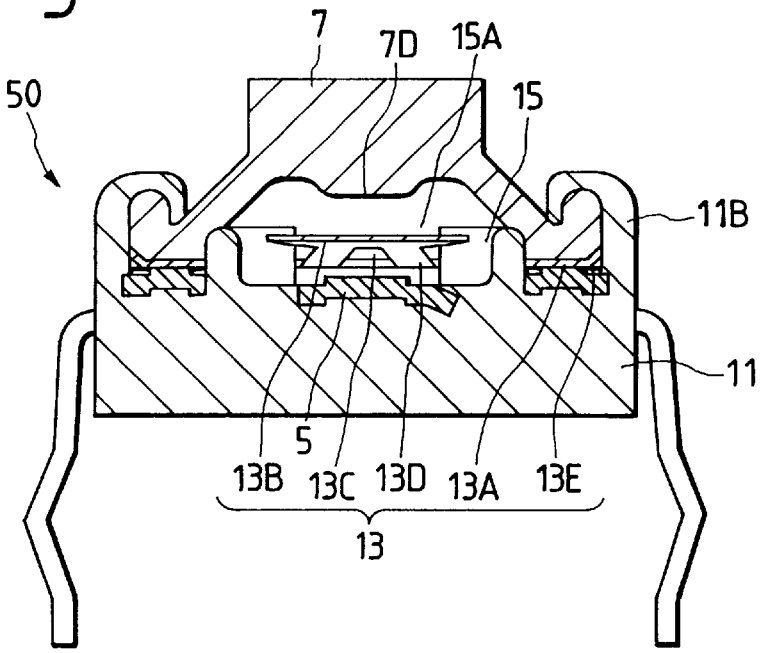
FIG. 5 is a cross sectional view which shows a push-on switch according to the second embodiment of the invention.
Figure 6A:
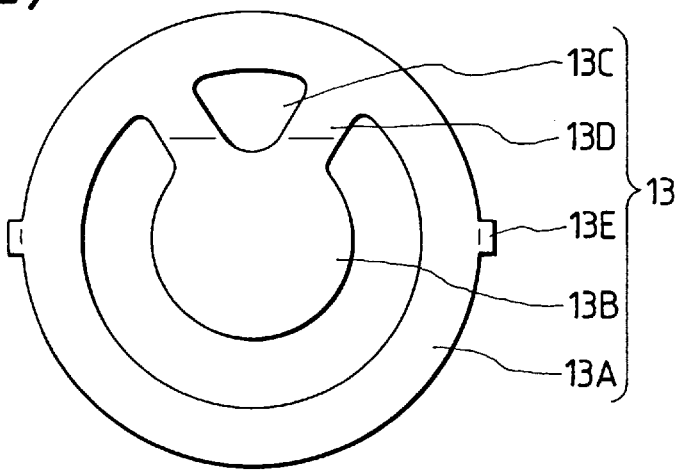
FIG. 6(*a*) is a plan view which shows a movable contact of the second embodiment.
Figure 6B:
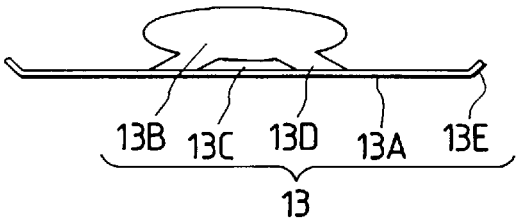

FIG. 5 shows the push-on switch 50 according to the second embodiment of the invention which is different from the above first embodiment in structure of the movable contact 13. Other arrangements are identical, and explanation thereof in detail will be omitted here.

The movable contact 13 includes the outer annular plate 13A, the central disc 13B, the press-fit claws 13E, and a pair of bridges 13D.

The bridges 13D extend radially from the central disc 13B to the outer annular plate 13A and are spaced in a circumferential direction across the opening 13C. Each of the bridges 13D has the width that is half that of the bridge 6C of the first embodiment. Specifically, the pressure required to urge the central disc 6B into engagement with the central stationary contact 5 is substantially the same as that in the first embodiment, but the two bridges 13D serves to prevent the central disc 13B from being twisted even when the pressure exerted from the push button 7 acts on the central disc 13B obliquely. This ensures a steady connection between the movable contact 13 and the central stationary contact 5.

Figure 7:
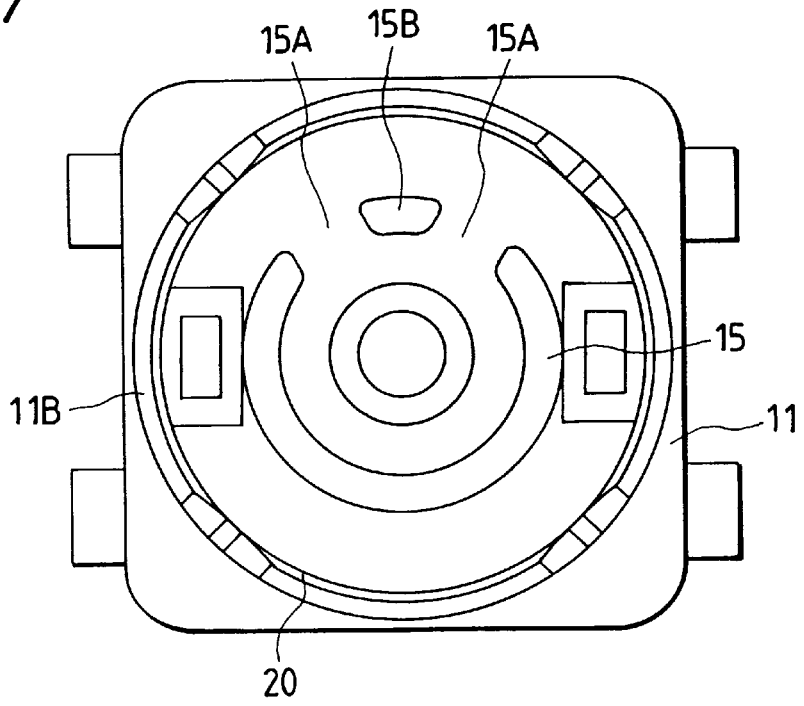
FIG. 7 is a plan view which shows a base of a push-on switch of the second embodiment.
Figure 8:
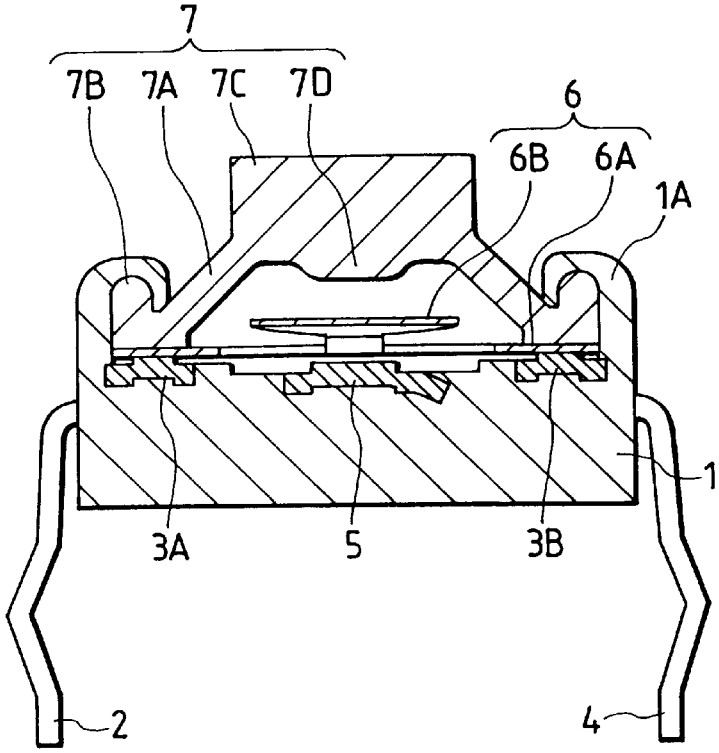
FIG. 8 PRIOR ART
FIG. 8 is a cross sectional view which shows a conventional push-on switch.
Figure 9A:
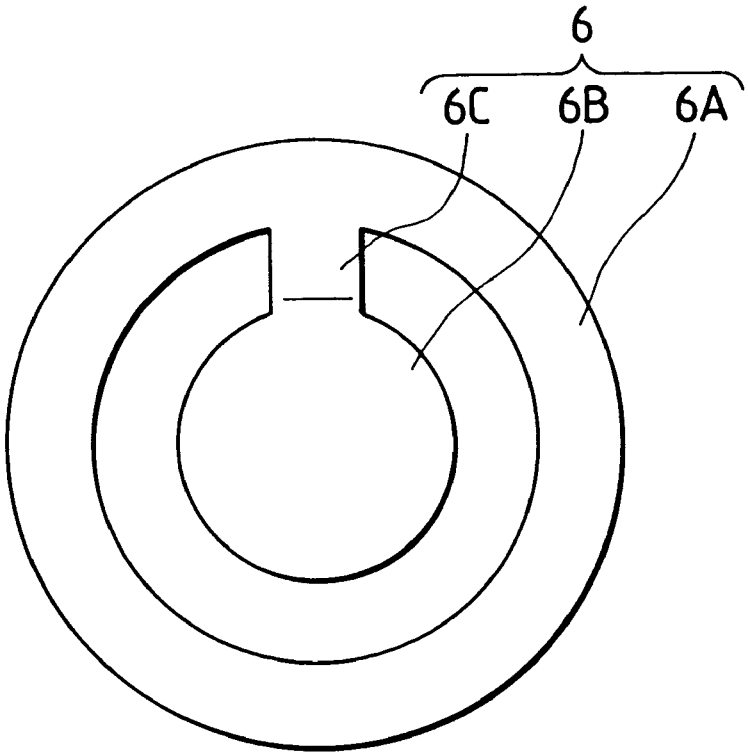
FIG. 9(a) PRIOR ART
FIG. 9(*a*) is a plan view which shows a movable contact of the conventional push-on switch in FIG. 8.
Figure 9B:
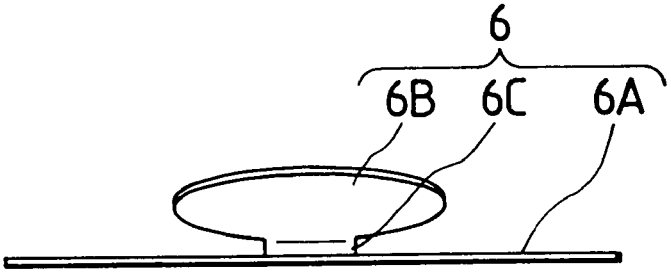
FIG. 9(b) PRIOR ART
Figure 10:
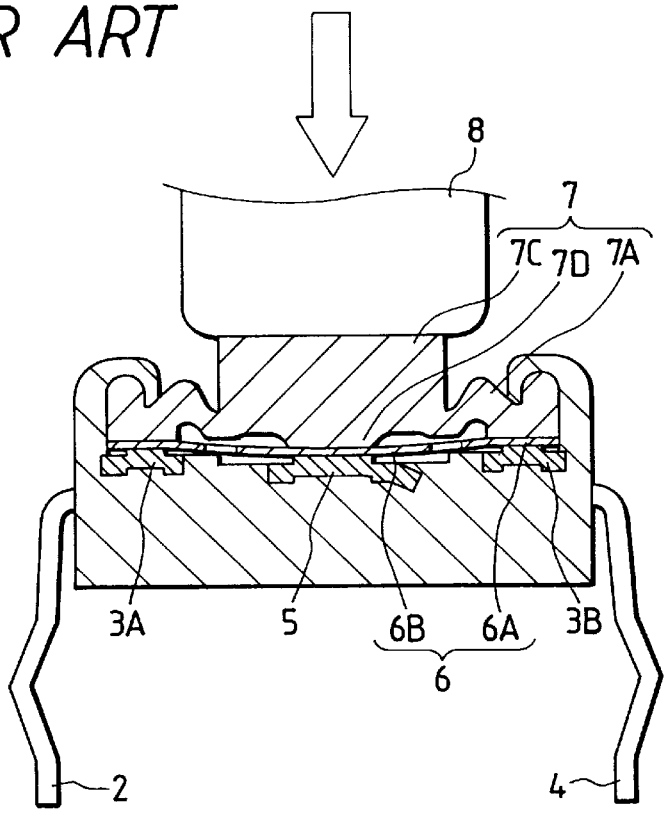
FIG. 10 PRIOR ART
FIG. 10 is an illustration which shows an operation of the conventional push-on switch in FIG. 8.
Figure 11:
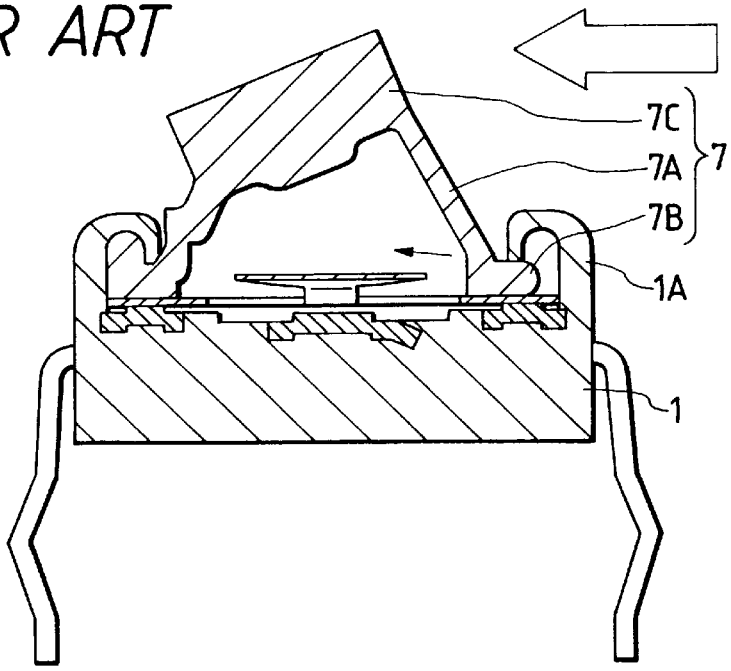
FIG. 11 PRIOR ART
FIG. 11 is an illustration which shows a push button of the conventional push-on switch in FIG. 8 when deformed by an accidental external pressure.

The annular rib 15, as shown in FIG. 7, has formed therein the two cut-out portions 15A across the central protrusion 15B. The cut-out portions 15A, similar to the first embodiment, receive the bridges 13D of the movable contact 13, respectively. The central protrusion 15B engages the opening 13C of the movable contact 13 for holding the movable contact 13 from moving in the circumferential direction.

The press-fit claws 13E of the movable contact 6 are forced into an inner wall of the annular peripheral wall 11B to hold the movable contact 6 tightly. This keeps the interval between the inner protrusion 7D of the push button 7 and the central disc 13B constant.

The movable contact 13 is press-fitted into the groove 20 between the annular rib 15 and the annular peripheral wall 11B of the base 11. This press-fit may be achieved by tight engagement of the outer annular plate 13A of the movable contact 13 with an outer wall of the annular rib 15 or the inner wall of the annular peripheral wall 11B.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A push-on switch comprising:

a resinous base having an annular peripheral wall and a surface surrounded by the annular peripheral wall, the annular peripheral wall extending substantially perpendicular to the surface;

a curled portion formed on an end of the annular peripheral wall of said resinous base, said curled portion having an end oriented toward the surface of said resinous base;

an annular rib formed on the surface of said resinous base inside said annular peripheral wall to define an annular groove between an outer wall of said annular rib and an inner wall of said annular peripheral wall, said annular rib extending away from the surface of said resinous base and inside the end of said curled portion to define an annular slit between the end of said curled portion and an end of said annular rib;

a first stationary contact disposed on the surface of said resinous base inside said annular rib;

a second stationary contact disposed on a bottom of the annular groove;

a movable contact including an outer annular portion and a central portion, the outer annular portion being disposed in said annular groove in electric connection with said second stationary contact and supporting the central portion at a contact gap away from said first stationary contact;

an operating button made from elastic material, including a central protrusion, a dome-shaped peripheral portion, and a flange portion formed on a periphery of the dome-shaped peripheral portion, the flange portion being contoured to an inner surface of said curled portion and fitted into said annular groove in tight engagement with said curled portion, the dome-shaped peripheral portion passing through the annular slit formed between said curled portion and said annular rib being held by said curled portion and said annular rib in tight engagement therewith to retain the central protrusion above the central portion of said movable contact.

2. A push-on switch as set forth in claim 1, wherein the central portion of said movable contact is connected to the outer annular portion through a bridge portion and disposed inside said annular rib, and wherein said annular rib has formed therein a cut-out portion through which the bridge portion of said movable contact passes.

3. A push-on switch as set forth in claim 2, further comprising a second bridge portion connecting the central portion and the outer annular portion of said movable contact, said second bridge portion extending radially from the central portion at a given angular interval away from said bridge portion.

4. A push-on switch as set forth in claim 1, wherein said curled portion elastically urges the flange portion of said operating button to bring the outer annular portion of said movable contact into constant engagement with said second stationary contact.

5. A push-on switch as set forth in claim 1, further comprising a recess formed in the bottom of the annular groove, and wherein said movable contact is made of a plate member having a given thickness, said second stationary contact being disposed within the recess at a given interval away from an inner side wall of the recess which is five to fifteen times the given thickness of said movable contact.

6. A push-on switch as set forth in claim 5, wherein said movable contact is made of a plate member having a given thickness, and wherein said second stationary contact projects from the bottom of the annular groove by a distance less than the given thickness of said movable contact.

7. A push-on switch as set forth in claim 1, wherein the outer annular portion of said movable contact is held within the annular groove in press-fit with one of the outer wall of said annular rib and the inner wall of said annular peripheral wall.

8. A push-on switch as set forth in claim 1, wherein said dome shaped peripheral portion is inclined at an angle to the surface of said resinous base and said curled portion on the end of the annular peripheral wall of said resinous base extends over at least a portion of said dome shaped peripheral portion, thereby vertically positioning said dome shaped peripheral portion and said operating button.

9. A push-on switch comprising:

a resinous base having an annular peripheral wall and a surface surrounded by the annular peripheral wall;

a curled portion formed on an end of the annular peripheral wall of said resinous base, said curled portion extending inward;

an annular rib formed on the surface of said resinous base inside said annular peripheral wall to define an annular groove between an outer wall of said annular rib and an inner wall of said annular peripheral wall;

a first stationary contact disposed on the surface of said resinous base inside said annular rib;

a second stationary contact disposed on a bottom of the annular groove;

a movable contact including an outer annular portion and a central portion, the outer annular portion being disposed in said annular groove in electric connection with said second stationary contact and supporting the central portion at a contact gap away from said first stationary contact;

an operating button made from elastic material, including a central protrusion, a dome-shaped peripheral portion, and a flange portion formed on a periphery of the dome-shaped peripheral portion, the flange portion being fitted into said annular groove in tight engagement with said curled portion, the dome-shaped peripheral portion being held by said curled portion and said annular rib in tight engagement therewith to retain the central protrusion above the central portion of said movable contact; and a recess formed in the bottom of the annular groove, wherein said movable contact is made of a plate member having a given thickness, said second stationary contact being disposed within the recess at a given interval away from an inner side wall of the recess which is five to fifteen times the given thickness of said movable contact.

10. A push-on switch as set forth in claim 9, wherein said movable contact is made of a plate member having a given thickness, and wherein said second stationary contact projects from the bottom of the annular groove by a distance less than the given thickness of said movable contact.

11. A push-on switch as set forth in claim 9, wherein the central portion of said movable contact is connected to the outer annular portion through a bridge portion and disposed inside said annular rib, and wherein said annular rib has formed therein a cut-out portion through which the bridge portion of said movable contact passes.

12. A push-on switch as set forth in claim 11, further comprising a second bridge portion connecting the central portion and the outer annular portion of said movable contact, said second bridge portion extending radially from the central portion at a given angular interval away from said bridge portion.

13. A push-on switch as set forth in claim 9, wherein said curled portion elastically urges the flange portion of said operating button to bring the outer annular portion of said movable contact into constant engagement with said second stationary contact.

14. A push-on switch as set forth in claim 9, wherein the outer annular portion of said movable contact is held within the annular groove in press-fit with one of the outer wall of said annular rib and the inner wall of said annular peripheral wall.

* * * * *